United States Patent [19]

Carlson et al.

[11] Patent Number: 4,685,481

[45] Date of Patent: Aug. 11, 1987

[54] WASHER FOR PLANT ROOTS AND OTHER ARTICLES

[75] Inventors: Steven J. Carlson; William W. Donald; James J. Lepine, all of Fargo, N. Dak.

[73] Assignee: The United States of America as represented by the Secretary of Agriculture, Washington, D.C.

[21] Appl. No.: 825,004

[22] Filed: Feb. 3, 1986

[51] Int. Cl.[4] ..... B08B 3/06

[52] U.S. Cl. ..... 134/155; 134/159; 134/160

[58] Field of Search ..... 134/135, 153, 155, 157, 134/158, 159, 160, 162; 68/148, 152, 153, 155, 156; 422/259, 300; 366/208, 209, 214

[56] References Cited

U.S. PATENT DOCUMENTS

| | | | |
|---|---|---|---|
| 420,637 | 2/1890 | Carriger | 68/156 |
| 849,627 | 4/1907 | Krehbiel | 134/159 |
| 970,872 | 9/1910 | Babcock | 134/135 X |
| 1,400,388 | 12/1921 | Stukey | 68/156 X |
| 1,430,554 | 10/1922 | Jacobs | 68/153 |
| 2,641,269 | 6/1953 | Jones et al. | 134/159 |
| 2,646,056 | 7/1953 | Korns | 134/155 X |
| 3,435,835 | 4/1969 | Hobbs | 134/108 |

FOREIGN PATENT DOCUMENTS

| | | | |
|---|---|---|---|
| 22711 | of 1910 | United Kingdom | 134/159 |

OTHER PUBLICATIONS

Gary R. Brown et al., "A Low-Cost Machine for Separation of Roots from Soil Material," J. Range Manage. 29(6): 506-507 (Nov. 1976).

P. K. Fay et al., "Technique for Separating Weed Seed from Soil," Weed Sci. 26(6): 530-533 (Nov. 1978).

*Primary Examiner*—Philip R. Coe

*Attorney, Agent, or Firm*—M. Howard Silverstein; David G. McConnell; Curtis P. Ribando

[57] ABSTRACT

A washing apparatus specifically designed for isolating plant roots from core soil samples is also suited for cleaning a variety of other organic and inorganic objects, particularly when surrounded by large volumes of soil. The essential features of the apparatus include a washing tank for holding a cleansing solvent, a support cradle for carrying cannisters of the samples to be cleaned, and a drive assembly for mobilizing the support cradle through the solvent in the washing tank.

5 Claims, 4 Drawing Figures

WASHER FOR PLANT ROOTS AND OTHER ARTICLES

BACKGROUND OF THE INVENTION

1. Field of the Invention

The protocol for certain agronomic studies such as those relating to the vegetative propagation of a plant species, involves isolation of roots or other plant tissue from soil core sample. Where the roots are very fine, this can be a difficult and tedious task. Due in part to the rather esoteric nature of this work, the technology for separating roots from soil has been slow to develop. As a result, advancements in this area of agronomy have also been less rapid than would have otherwise been expected.

2. Description of the Prior Art

Various devices have been constructed to extract the total root system of plants from field soil. One of the earliest root washers reported by H. A. Fribourg [Agron. J. 45: 334–335 (1953)] consisted of a stack of 14 wooden trays. Individual soil samples were placed into each tray and the stack was soaked in water containing a wetting agent. After soaking, the soil samples were placed on a slatted platform, and the loosened soil was washed from the roots with a spray of water. J. B. Fehrenbacher et al. [Agron. J. 47: 468–472 (1955)] described a design which consisted of eight pans with screened bottoms in which soil samples were placed. The pans were suspended in water and shaken. The soil settled through the screen, and the roots were skimmed off the water surface. In an apparatus reported by G. A. Cahoon et al. [Proc. Am. Soc. Hort. Sci. 78: 593–596 (1961)], angled jets of water were used to spin soil and roots on a cone within a container. The motion moved the roots and fine soil particles up the cone leaving the larger soil particles behind. The roots and fine soil particles dropped onto a classifying screen and were separated by washing.

In a more recent root washer designed by G. R. Brown et al. [J. Range Manage. 29: 506–507 (1976)], soil was placed into screen cannisters which were secured to a rotating agitator. As the agitator rotated through water, the soil was washed out of the cannisters and the roots retained inside. A washer reported by K. J. Ward et al. [Agron. J. 70: 675–677 (1978)] consisted of cloth bags filled with soil and suspended in water from laboratory wrist-action shakers. The shakers moved the bags in the water to wash out the fine soil particles. After removal from the bag, the roots were separated from the larger soil particles by decanting water which contained the floating roots. A root washing apparatus which relied upon application of pressurized water and air to soil samples submerged in water was reported by A. J. M. Smucker et al. [Agron. J. 74: 500–503 (1982)]. The combined action of the air and water loosened the roots from the soil. The loosened roots and fine soil particles floated to a screen which retained the roots but allowed the fine soil particles to be washed through. Fay et al. [Weed Sci. 26: 530–533 (1978)] disclosed an apparatus for extracting seeds from soil samples secured in nylon mesh bags. The bags were placed in a basket suspended from a crankshaft in a water tank. Vertical displacement of the basket in the tank provided the requisite agitation for removing soil particles from the bags.

By and large, the heretofore described devices were designed to wash relatively small volumes of soil, were highly labor intensive, and were not especially effective when applied to cohesive clay soils.

SUMMARY OF THE INVENTION

We have now devised a washing apparatus for cleanly and efficiently separating a coarse component such as plant tissue from a relatively fine, contaminant material such as soil without many of the problems characteristic of prior art devices. The apparatus comprises the following components:

(a) a wash tank for holding a liquid solvent;
(b) a rotatable off-set shaft mounted near the top of the tank;
(c) a drive means for rotating the off-set shaft;
(d) a cannister support cradle pivotally mounted on the off-set segment of the shaft; and
(e) one or more cannisters for containing the sample, wherein the cannisters are permeable to the solvent and to the contaminant material, but impermeable to the sample.

In accordance with this discovery, it is an object of the invention to provide an apparatus which is sufficiently versatile to effectively separate soil and other fine particulate material from a wide variety of coarse objects contaminated therewith:

It is a specific object of this invention to provide an apparatus for rapidly isolating roots, seeds, or other plant tissue from soil core samples in which the soil largely surrounds and is adherent to the plant tissue.

It is another object of the invention that the washing action of the subject apparatus be sufficiently gentle so as to avoid damaging delicate plant tissue.

It is also an object of the invention that the above-described apparatus accommodate a large volume of material in a comparatively short treatment time.

A further object of the invention is that the above-described apparatus be adapted for rapid loading of the sample and recovery of the cleaned material.

Another object of the invention is that the washing apparatus herein described be engineered for durability, reliability, and facile maintenance.

Other objects and advantages of this invention will become readily apparent from the ensuing description.

DETAILED DESCRIPTION OF THE INVENTION

The apparatus of this invention was designed primarily for the purpose of isolating roots and other plant material such as seeds, rhizomes, and tubers from core samples of soil. The principle of the system relies upon the agitative action of water or some other solvent to separate and carry the relatively fine soil particles from the coarse plant material. The ensuing description of the invention will be described in this context. It is envisioned, however, that the subject apparatus would be useful for cleaning or isolating a wide variety of organic and inorganic objects. The basic prerequisite for operability is that the component to be recovered be of a coarse, particulate, or filamentous nature, and that the contaminant material to be removed be relatively fine. The device is especially suited for cleansing objects which are heavily laden with soil. For example, insects, animal remains, archeological artifacts, and precious stones could be readily separated from soil or sand by means of this novel device. By virtue of the gentle, agitative action of the water, contaminant particles which are loosely affiliated with the coarse component as well as those adherent thereto are eventually dislodged and swept away.

The washing apparatus essentially comprises: (1) a washing tank; (2) a cannister support cradle for carrying cannisters containing the objects to be cleaned through the washing tank; and (3) a drive assembly for mobilizing the support cradle.

Figure 1:
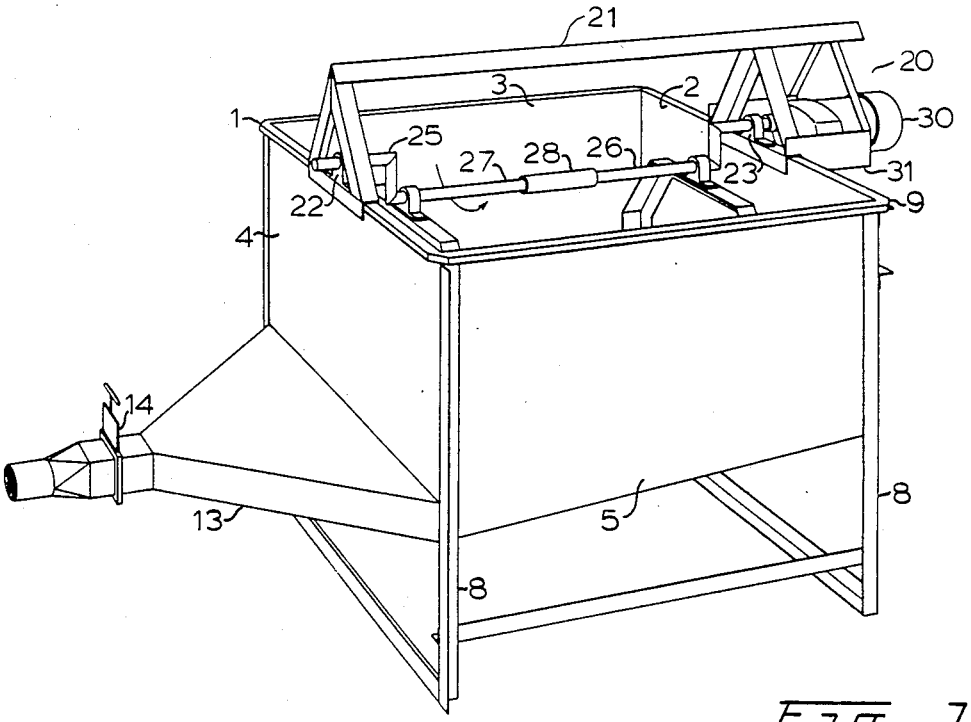
FIG. 1 is a perspective view of the plant root and seed washer.
Figure 2:
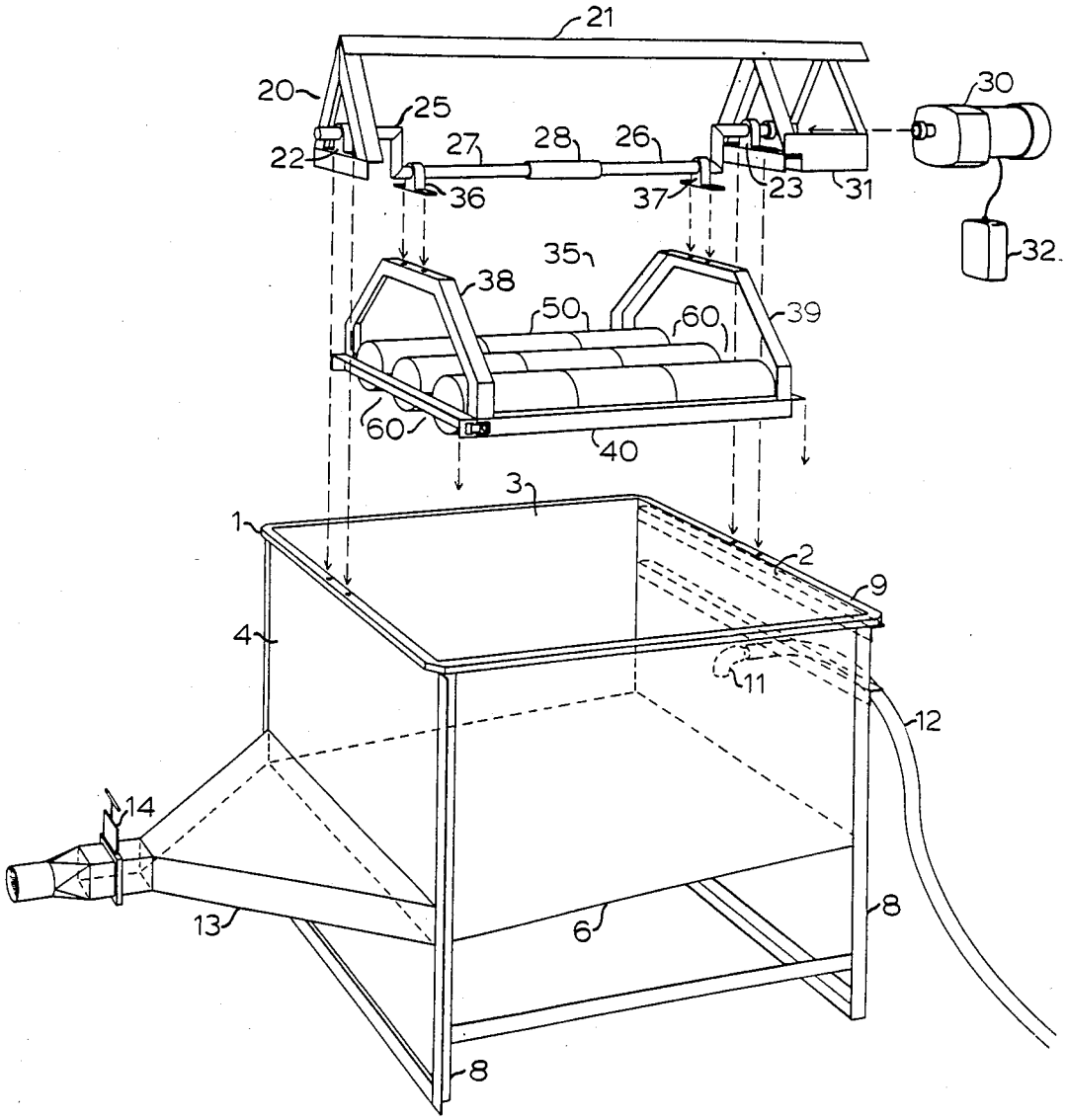
FIG. 2 is an exploded perspective view of the plant root and seed washer depicted in FIG. 1.

Referring to FIGS. 1 and 2, the washing tank 1 comprises side walls 2, 3, 4, and 5, and a sloping bottom wall 6. The tank is supported by legs 8 and optionally has a lip 9 around its upper perimeter in order to enhance its rigidity and to facilitate mounting of the drive assembly. Side wall 2, hereinafter referred to as the back wall, is fitted with an inlet 11 for connection to a supply line 12 for water or other liquid cleansing solvent. The bottom wall 6 of tank 1 slopes downwardly from the back wall 2 to side wall 4, hereafter referred to as the front wall. At the front wall, the tank drains into a tapering discharge duct 13 equipped with a valve 14 illustrated by a quick opening gate valve.

Figure 3:
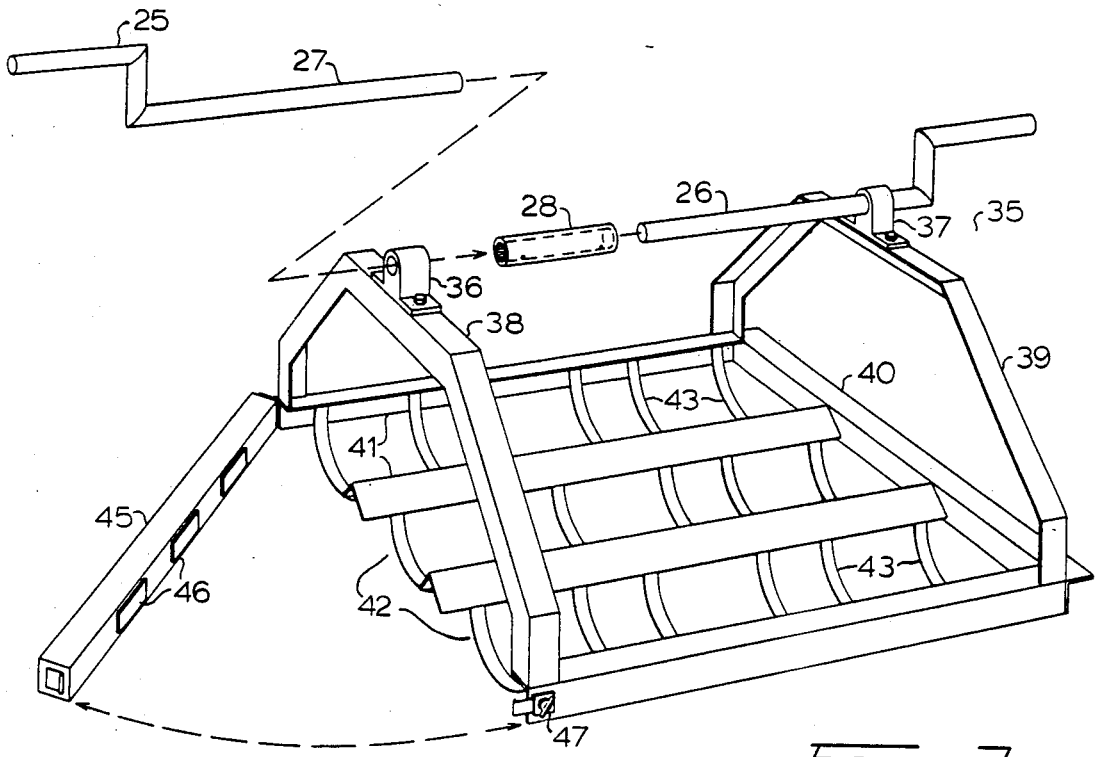
FIG. 3 is a detailed perspective view of the cannister support cradle.

The drive assembly 20 straddles the top of the tank 1 and is preferably mounted on the lip 9 protruding over each of the front wall 4 and the back wall 2. The assembly comprises a support frame 21 having a front main bearing 22 and a rear main bearing 23 for journalling of off-set shaft 25. The shaft is "off-set" in the sense that at least a segment thereof is offset from the axis of rotation of the shaft as illustrated in FIGS. 1, 2, and 3. The shaft is powered by a motor 30 of any suitable design which is supported in the assembly on motor mount 31. The motor may optionally be switched into a timer 32 so that the duration of the washing cycles may be preset and automatically controlled. In the preferred embodiment of the invention depicted in the drawings, the off-set shaft 25 is a three-part assembly comprising: the proximal, driven end 26; the distal, follower end 27; and a coupler 28. A suitable coupler consists of a high tolerance sleeve secured to each section of the shaft by means of set screws or the equivalent. This arrangement facilitates removal of the crank for purposes of replacing bearings and other general maintenance.

The cannister support cradle 35 as best illustrated in FIGS. 2 and 3 is journalled to off-set shaft 25 by means of bearings 36 and 37 mounted atop cradle arms 38 and 39, respectively. The cradle arms 38 and 39 are attached to the primary cradle framework 40, which defines one or more cannister bays 42. Each bay includes a plurality of arcuate support bands 43 suspended between parallel members 41 of the framework 40. The bands 43 should be of sufficient number and dimension to support the cannisters, without substantially impeding the flow of solvent and soil particles being separated from the roots in the sample. Typically, two thin but durable bands per cannister are sufficient for this purpose. The cannisters 50 are further secured in place by frictional engagement between the backside of framework 40 and pressure arm 45. Pressure arm 45 is fitted with a pad 46 of rubber or other resilient material in alignment with the end of each bay 42 for compressing the cannisters in place when the arm is held in its closed position by latch 47. By virtue of the cradle configuration, indentation spaces 60 exist between adjacent rows of the cylindrical cannisters, both above and below the cradle.

Figure 4:
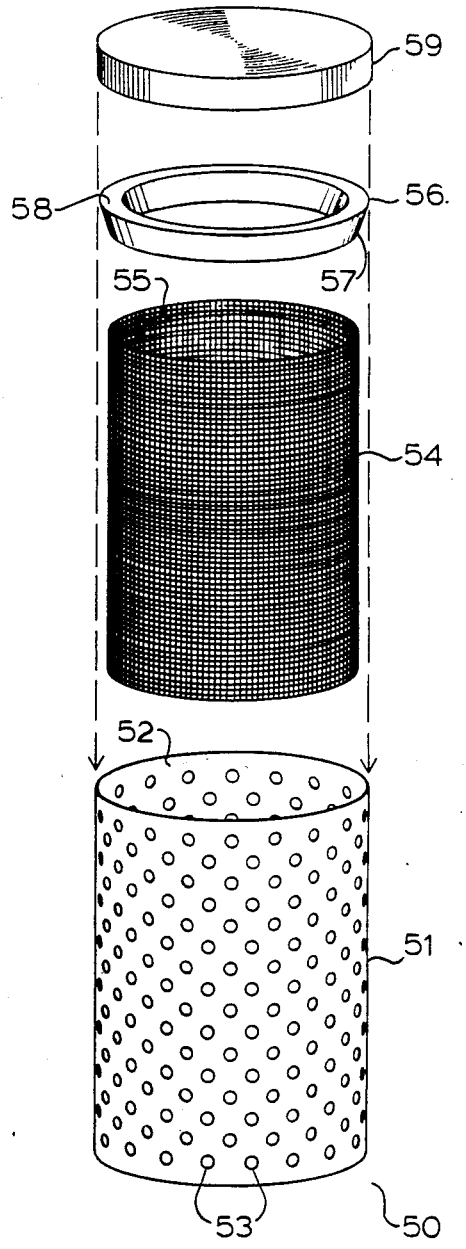
FIG. 4 is an exploded view of the cannister assembly.

As shown in FIG. 4, each of the cannisters 50 comprises a rigid outer shell 51, a fine mesh inner shell 54, a sealing gasket 56, and a lid 59. The porous rigid outer shell 51 is designed to provide protection to the inner shell 54, and strength for frictional engagement from pressure arm 45. At the same time, outer shell 51 allows flow of solvent and soil particles through the cylindrical side wall 52. The embodiment illustrated in the figure having perforations 53 has proven to be functional for this purpose, though it is envisioned that the side wall 52 could suitably be constructed from hardware cloth, expanded metal, or the like. The material and specific design chosen for the side wall 52 will depend in part upon the strength requirements for the intended application. The bottom of the outer shell 51 may be solid in that it is not relied upon for material flow.

The mesh size of the cylindrical wall 55 of inner shell 54 is selected to preferentially separate the roots from the soil particles in the particular sample being treated. The inner shell 54 is sized to easily slip into the outer shell 51. The bottom of inner shell 54 may be of the same fabric comprising the cylindrical wall 55, or it may alternatively be fabricated from some other material which serves to contain the roots.

The top of the cannister assembly is closed by means of a lid and gasket combination. Gasket 56 is tapered inwardly from top to bottom along its outer periphery 57 so as to compress the inner shell 54 against the interior of outer shell 51. The top surface 58 of gasket 56 is flattened or otherwise contoured to sealingly engage with the compatibly shaped interior surface of lid 59. Closure is achieved by frictional engagement of the lid with the exterior of cylindrical wall 52 of outer shell 51.

In operation, each cannister 50 is prepared by positioning the inner shell 54 within the outer shell 51 and thereafter loading the soil sample to be washed. Gasket 56 and lid 59 are then installed as previously described, and the assembly is placed in cradle 35. In the event that the number of loaded cannisters is less than the cradle capacity, the remaining space in each partially occupied bay should be filled with empty cannisters. This step serves to balance the cradle and to effectuate the operability of pressure arm 45.

Prior to commencing the wash cycle, tank 1 is filled with water to the desired level. Soil dispersants or detergents may be added to the water as necessary, provided they are compatible with the plant material. Motor 30 is switched ON and is optionally set to switch OFF after a predetermined interval by means of timer 32. As shaft 25 rotates, the cradle 35 and each of the cannisters travels in a circular path. The water level in tank 1 should be such that the cannisters will be totally submerged for at least a portion of each revolution. Mild turbulence created by movement of the cradle 35 through the wash water acts to separate soil particles from the plant material, and to carry them into the water through the openings in the respective shells of the cannisters. The turbulence is in part attributed to currents moving along troughs 60. Advantage can also be taken of the surface tension of the water to facilitate separation by selecting a water level somewhat lower than the top of each stroke so that the cannisters repeatedly emerge from and reenter the water.

At the completion of the wash cycle, valve 14 is opened to drain the water and soil from tank 1 through discharge duct 13. Residual soil which may have settled on the bottom of the tank can be swept out either by fresh water emitted from inlet 11 or by use of a water spray from a hand-held hose (not shown). The sloping bottom wall facilitates washing soil from tank 1. The cleaned material is recovered by removal from the cannisters. When pebbles, rocks, and other extraneous debris are present in the original sample, they of course will also be retained within the cannisters in discrete form. Additional separation or classification of the cleaned material is therefore sometimes required. Due to the gentle agitation achieved by this device, the integrity of delicate plant tissue is preserved.

It is understood that the foregoing detailed description is given merely by way of illustration and that modification and variations may be made therein without departing from the spirit and scope of the invention. For example, it would be appreciated by the person in the art that parameters such as the shaft off-set, rate of shaft rotation, and mesh size of the cannister shells may be varied depending upon the prospective use.

We claim:

1. A washing apparatus for separating a coarse component from a relatively fine, contaminant material in a sample comprising;

(a) a tank for holding a liquid solvent, said tank having an upper perimeter;

(b) a rotatable shaft mounted near the upper perimeter of the tank, said shaft having an axis of rotation and a segment which is off-set from said axis of rotation;

(c) a drive means for rotating the shaft;

(d) a cannister support cradle pivotally mounted on the off-set segment of the shaft and adapted for securing one or more cannisters; and (e) said one or more cannisters for containing said sample, wherein said cannisters are permeable to the solvent and to the contaminant material.

2. The apparatus as described in claim 1, wherein said tank comprises a first side wall having an inlet, a second side wall opposite the first side wall and having a valved discharge duct, and a bottom wall which slopes downwardly from said first side wall to said second side wall, wherein said valved discharge duct in said second side wall is located near said bottom wall.

3. The apparatus as described in claim 1, wherein the cradle is provided with means for frictionally securing the cannisters in place.

4. The apparatus as described in claim 1 wherein each of said cannisters comprises a porous rigid outer shell and a relatively fine mesh inner shell.

5. The apparatus as described in claim 1 wherein said shaft comprises a proximal end and a detachable distal end secured to the proximal end by means of a coupling.

* * * * *